US008376786B2

(12) United States Patent
Carreras Garcia et al.

(10) Patent No.: US 8,376,786 B2
(45) Date of Patent: Feb. 19, 2013

(54) RELEASABLE PLUG AND JACK HAVING DETENT MEANS

(75) Inventors: Antonio Carreras Garcia, Terrassa (Barcelona) (ES); Albert Font Aranega, Badalona (Barcelona) (ES)

(73) Assignee: Tyco Electronics AMP Espana SA, Barcelona (ES)

( * ) Notice: Subject to any disclaimer, the term of this patent is extended or adjusted under 35 U.S.C. 154(b) by 244 days.

(21) Appl. No.: 12/660,435

(22) Filed: Feb. 26, 2010

(65) Prior Publication Data

US 2010/0221943 A1 Sep. 2, 2010

(30) Foreign Application Priority Data

Feb. 27, 2009 (EP) ..... 09380035

(51) Int. Cl.
*H01R 24/00* (2011.01)

(52) U.S. Cl. ..... 439/676; 439/677; 439/680; 439/382

(58) Field of Classification Search ..... 439/676, 439/677, 680, 382–385, 370
See application file for complete search history.

(56) References Cited

U.S. PATENT DOCUMENTS 4,265,503 A * 5/1981 Baur ..... 439/258
4,838,809 A * 6/1989 Mouissie ..... 439/155
4,906,210 A * 3/1990 McNiel ..... 439/839
4,915,648 A * 4/1990 Takase et al. ..... 439/490
5,655,916 A * 8/1997 Hayashi ..... 439/155
6,257,935 B1 7/2001 Zhang et al.
6,296,528 B1 * 10/2001 Roberts et al. ..... 439/676
6,312,293 B1 11/2001 Wang
6,350,156 B1 * 2/2002 Hasircoglu et al. ..... 439/676
6,350,157 B1 2/2002 Mizusawa
6,354,884 B1 3/2002 Yeh et al.
6,482,019 B1 * 11/2002 Lo Forte et al. ..... 439/131
6,808,427 B1 * 10/2004 Xue ..... 439/676
6,869,297 B2 * 3/2005 Caveney ..... 439/138
6,987,852 B2 * 1/2006 Kameya et al. ..... 379/438
7,850,493 B2 * 12/2010 Lee et al. ..... 439/677
2002/0197912 A1 12/2002 Wang et al.
2004/0235358 A1 * 11/2004 Wan et al. ..... 439/676
2007/0049126 A1 3/2007 Hsu et al.
2008/0220657 A1 * 9/2008 Rascon et al. ..... 439/676

OTHER PUBLICATIONS

European Search Report, dated Jul. 20, 2009, issued by the European Patent Office, Munich, Germany for European Application No. 09380035.7; 2 pages.

* cited by examiner

*Primary Examiner* — Tho D Ta
(74) *Attorney, Agent, or Firm* — Faegre Baker Daniels LLP

(57) ABSTRACT

A plug and jack adapted to fit together with the plug releasably secured in the jack by detent means, so that plug electrical contacts carried by the plug are in electrical connection with jack electrical contacts carried by the jack, wherein spring means are provided which act between the plug and the jack to limit or eliminate movement of the secured plug relative to the jack.

14 Claims, 1 Drawing Sheet

RELEASABLE PLUG AND JACK HAVING DETENT MEANS

This invention relates to an improved plug and jack, particularly, but not exclusively, of the kind well known in telecommunications and data transmission systems, which are adapted to fit together with the plug releasably secured in the jack by detent means, so that plug electrical contacts carried by the plug are in electrical connection with jack electrical contacts carried by the jack. In well known forms of these plugs and jacks, the electrical contacts are curved springy strips of metal that make electrical connection to each other within an interface zone extending over a certain length of contact strips.

With the currently increasing demand for higher data transmission speeds, it is highly desirable to improve the quality of plug and jack connections in order to reduce or avoid unwanted interference with the signals at such connect points.

The present invention accordingly provides a plug and jack adapted to fit together with the plug releasably secured in the jack by detent means, so that plug electrical contacts carried by the plug are in the electrical connection with jack electrical contacts carried by the jack, wherein spring means are provided which act between the plug and the jack to limit or eliminate movement of the secured plug relative to the jack.

The plug and jack according to this invention have the advantage that the spring means reduces or eliminates looseness of the plug fit within the jack, thus tending to reduce relative movement of the plug and jack contacts which could otherwise detract from the quality of the electrical connection in the contact interface zone. Well known jacks and plugs, for example of the RJ45 type, are designed with some clearance allowing insertion of the plug sufficiently far into the jack to engage a shoulder of a resilient latch lever with a retaining surface of the jack housing, as is well known. This arrangement normally results in some clearance space permitting forward and back movement of the plug to a small extent within the jack after the latch has been secured, and variations in manufacturing tolerances and ambient temperature can add to the potential movement of the plug within the jack. The spring means provided according to the present invention can be arranged so that it takes up all of such clearance space and permanently applies stabilizing pressure between the plug and the jack to resist movement of the secured plug. Alternatively the spring means may be arranged to take up only part of the aforementioned clearance space, as will be explained further on.

In preferred embodiments of this invention, the spring means is arranged to be deformable in the direction of insertion of the plug into the jack, and recovers to urge the plug in the opposite direction after the plug has been secured in the jack. It follows that the spring means is preferably located between the end of the jack cavity facing the plug and the front end of the plug when inserted in the cavity, but the spring means could be located elsewhere, for example alongside the plug or even at the rear end of the plug. It may be especially convenient to form the spring means integrally with a part of the jack or plug, for example in the form of at least one springy arm projecting from a portion of the jack or plug. Separate forms of spring, for example coil or leaf springs, may be used if desired. It is preferred that the spring means is carried by the jack. It may readily be seen that the spring means could be carried by or incorporated in the plug, but this is not preferred, in order to keep the plug design simple and lightweight. The spring means, in whatever form is chosen, is preferably located at the end of the jack cavity facing the plug, as aforesaid.

In preferred jack and plug assemblies according to the invention, the plug is releasably latched into the jack housing, usually by engagement of a shoulder on the resilient plug latch lever with a latching surface of the jack housing. The spring means urges the plug towards or against the latch engagement to reduce or eliminate clearance space which would otherwise permit undesired relative movement between the plug and the jack, that could detract from the quality of the desired electrical connection. The invention is especially useful in plug and jack assemblies for telecommunications or data signaling systems. Preferred forms of the invention specifically include the jack alone carrying the spring means for use in a plug and jack assembly as described above. A specific embodiment of the present invention will now be described by way of example, with reference to the accompanying drawings, wherein:

Figure 5:
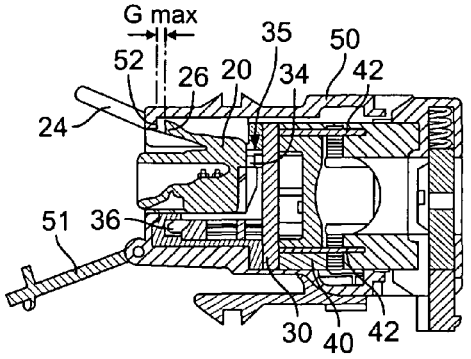
FIG. 5 shows in cross section the sub-assembly of FIG. 4 fitted into a jack housing similar to that of FIG. 2, with a plug of known kind inserted in the jack cavity to the maximum extent allowed by compression of the spring means according to the invention.
Figure 6:
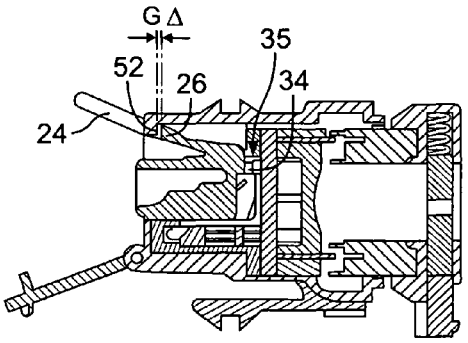
Figure 7:
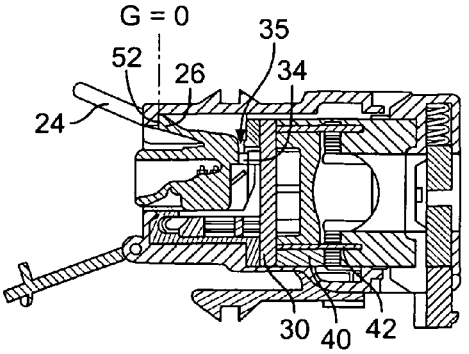

FIG. 6 shows in cross section a plug and jack assembly similar to that of FIG. 5 where the spring means according to the invention has recovered to take up some, but not all, of the clearance between the jack housing and the engaging shoulder of the plug latch lever; and FIG. 7 shows a similar plug and jack assembly in which the spring means according to the invention has taken up substantially all of the clearance between the plug and the jack housing.

Figure 1:
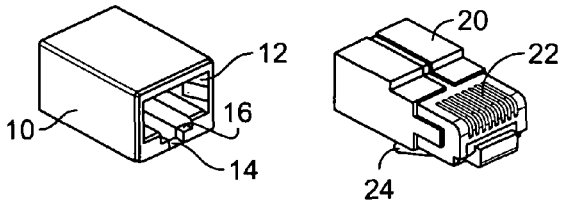
FIG. 1 shows in perspective a plug and jack of known kind.

Referring to the drawings, FIG. 1 shows a jack housing 10 and plug 20 of known kind. The housing 10 encloses a cavity 12 within which the jack electrical contacts allocated (not visible in this view) to make electrical connection with the plug contacts 22 when the plug is inserted into the jack cavity. The jack housing has a recess 14 which receives the latch lever 24 of the plug, and a shoulder 16, which engages a latching shoulder (not visible in this view) of the plug latch lever 24, as known per se.

Figure 2:
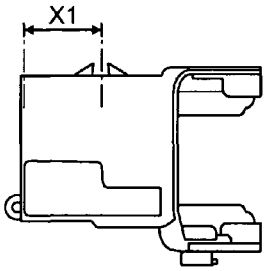
FIG. 2 shows a jack housing of known kind.

FIG. 2 shows a schematic side view of a jack housing of generally known kind, in which the jack electrical contacts will be contained within the length indicated as X1, and into which plugs will be inserted from the left hand end of the housing as shown in this view.

Figure 3:
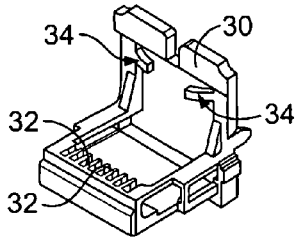
FIG. 3 shows a plastic frame contact carrier to be inserted in the jack housing of FIG. 2, with spring means according to the present invention integral with the frame.

FIG. 3 shows a moulded plastics contact carrier 30 having a tray formation with recesses 32 within which the jack contacts will be located, and an upstanding frame part of the carrier 30 includes springy arms 34 which constitute the spring means according to the present invention in this embodiment.

Figure 4:
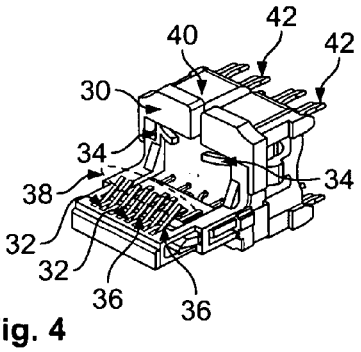
FIG. 4 shows a sub-assembly of the contact frame of FIG. 3 together with a body carrying wire-receiving contacts of known kind.

FIG. 4 shows the carrier 30 of FIG. 3 with its spring arms 34, pre-assembled together with a wiring body 40 from which project rearwardly wire-receiving contacts 42 of the usual insulation-displacing kind. The forward-projecting part of the support frame 30 has jack contacts 36 positioned in the recesses 32, and the preferred electrical connection region of these contacts, which will make electrical connection with the plug contacts in use, is indicated by the oval 38.

FIG. 5 shows in cross section the sub-assembly of FIG. 4 comprising the jack contact support frame 30 and the body 40 with wire-receiving contacts 42, inserted in a jack housing 50 somewhat similar to that shown in FIG. 2, and with a plug 20 inserted in the jack cavity that has been opened by hinged movement of the protective lid 51 of the housing, as known per se. The plug contacts (not shown in this view) make connection with the jack contact 36. The wire-carrying cables, that are in practice attached to the plug 20 at the left of this view and to the wire-receiving contacts 42 at the right of this view, have been omitted for simplicity. The plug 20 is shown inserted to the maximum possible extent in the jack cavity, so that the spring arms 34 of the support frame 30 are compressed against the front surface of the plug 20 in a plug/spring interface region 35. This allows the plug 20 to enter far enough into the jack cavity for the latching shoulder 26 of the plug latch lever 24 to clear the corresponding latching shoulder 52 of the jack housing 50 in order to latch the plug within the jack. In this example, with maximum plug insertion, a gap "G" between the respective latching shoulders 26 and 52 is at its maximum.

In FIG. 6, the spring arms 34 of FIG. 5 recover in the plug/spring interface region 35 only far enough to push the plug back to the left (as illustrated) to reduce the gap G between the respective latching shoulders 26 and 52, thus reducing the clearance space for movement of the plug relative to the jack and so reducing the risk of such movement adversely affecting the quality of electrical connection within the connection region 38 shown in FIG. 4.

FIG. 7 correspondingly shows the situation where the recovery of the spring arms 34 within the interface region 35 has reduced the gap G between the respective latching shoulders 26 and 52 substantially to zero thus resisting any movement of the plug which could detract from the connection quality. In this embodiment, the plug would, of course, still be able to move against the resilient force of the arm 34, but free play movement of the plug is substantially eliminated. The resilience of the arm 34 and some natural resilience in the plug and housing materials (usually plastics) enables disengagement of the respective latching shoulders 26 and 52 upon downward movement of the plug latching lever 24 as shown in this view.

The invention claimed is:

1. A plug and jack adapted to fit together with the plug releasably secured in the jack by detent means, so that plug electrical contacts carried by the plug are in electrical connection with jack electrical contacts carried by the jack, the jack comprising a contact carrier having a contact carrier tray supporting the jack electrical contacts and having an upstanding frame part with spring means which act between the plug and the jack to limit or eliminate movement of the secured plug relative to the jack, the spring means being a one-piece construction with the upstanding frame.

2. A plug and jack according to claim 1, wherein the spring means is arranged to be deformable in the direction of insertion of the plug into the jack and to urge the plug in the opposite direction after the plug is secured in the jack.

3. A plug and jack according to claim 1, wherein the spring means is integral with part of the jack or plug.

4. A jack and plug according to claim 1, wherein the spring means comprises at least one resilient flexible arm projecting from a part of the jack or plug.

5. A plug and jack according to claim 1, wherein the plug has a resilient latch that engages a latching surface of the jack, and the spring means urges the plug towards or against the latching surface of the jack.

6. A jack and plug according to claim 1, suitable for telecommunications or data transmissions systems.

7. A plug and jack according to claim 1, wherein the spring means is carried by the jack.

8. A plug and jack according to claim 7, wherein the spring means is positioned at the end of the jack cavity facing the plug.

9. The jack of a plug and jack according to claim 7, which jack is supplied separately from the plug.

10. A jack adapted to fit together with a plug releasably secured in the jack, the jack comprising: a jack housing having a jack cavity for receiving the plug; jack electrical contacts carried by the jack housing; and a spring provided relative to the jack housing to limit or eliminate movement of the secured plug relative to the jack so that plug electrical contacts carried by the plug are in electrical connection with the jack electrical contacts, the spring being a one-piece construction with the jack housing and positioned within the jack cavity and being profiled to engage a front face of the plug.

11. A jack according to claim 10, wherein the spring is arranged to be deformable in the direction of insertion of the plug into the jack and to urge the plug in the opposite direction after the plug is secured in the jack.

12. A jack according to claims 10, wherein the spring comprises at least one resilient flexible arm projecting from a part of the jack.

13. A jack according to claim 12, wherein the spring is carried by the jack.

14. A plug and jack according to claim 13, wherein the spring positioned at the end of the jack cavity facing the plug.

* * * * *